US005979314A

United States Patent [19]

White

[11] Patent Number: 5,979,314

[45] Date of Patent: Nov. 9, 1999

[54] LITHOGRAPHIC DAMPENER

[75] Inventor: Arthur H. White, Washington Township, N.J.

[73] Assignee: Varn Products Company, Inc., Oakland, N.J.

[21] Appl. No.: 08/598,571

[22] Filed: Feb. 12, 1996

Related U.S. Application Data

[63] Continuation-in-part of application No. 08/292,875, Aug. 19, 1994, abandoned.

[51] Int. Cl.[6] ..... B41F 7/26; B41F 7/32; B41F 7/36

[52] U.S. Cl. ..... 101/148

[58] Field of Search ..... 101/148, 147, 101/348, 349, 351, 352, 217, 216

[56] References Cited

U.S. PATENT DOCUMENTS

| | | | |
|---|---|---|---|
| 4,301,730 | 11/1981 | Heurich et al. | 101/348 |
| 4,455,938 | 6/1984 | Loudon | 101/148 |
| 4,887,528 | 12/1989 | Ruge et al. | 101/148 |
| 4,901,640 | 2/1990 | Niemiro et al. | 101/349 |
| 4,932,319 | 6/1990 | Switall | 101/147 |
| 4,991,501 | 2/1991 | Yokoyama et al. | 101/148 |
| 5,093,180 | 3/1992 | Morgan | 101/375 |

*Primary Examiner*—J. Reed Fisher

*Attorney, Agent, or Firm*—James W. Jakobsen; Joseph G. Nauman

[57] ABSTRACT

A continuous seal type lithographic dampener is fitted with a one-piece metering roller which has a continuous surface coating of flame sprayed (as by plasma arc) chromium oxide particles providing a porous surface which is filled with a pore occluding sealer. The resulting cylindrical surface is than ground to a finish in the order of 20 to 30 micro inches. A finish coat of sealer is applied to the surface of the roller. The resultant metering roller is highly wear resistant and hydrophobic, having a surface energy in the order of 30 to 40 dynes/cm.

6 Claims, 2 Drawing Sheets

LITHOGRAPHIC DAMPENER

CROSS-REFERENCE TO RELATED APPLICATION

This application is a continuation-in-part of application Ser. No. 8/292,875, filed Aug. 19, 1994, now abandoned, entitled IMPROVED LITHOGRAPHIC DAMPENER.

FIELD OF THE INVENTION

This invention relates to improvements in dampeners for lithographic printing presses, particularly dampeners of the continuous type as disclosed in U.S. Pat. No. 4,455,938 issued Jan. 26, 1984, and U.S. Pat. No. 5,134,935 issued Aug. 4, 1992.

BACKGROUND OF THE INVENTION

The dampener disclosed in the aforementioned U.S. Pat. No. 4,555,938 has achieved wide acceptance, and has undergone evolvement during the past decade (as demonstrated in U.S. Pat. No. 5,134,935). However, it retains the essence of the direct continuous contact dampening process, in which the dampener form roller runs in continuous contact with the press form cylinder and the form (printing plate) thereon, and in which the metering roller runs in continuous pressure contact with the form roller, defining a downwardly and inwardly moving nip between the rollers.

In these dampeners the surface of the form roller is made of a compressible material while the surface of the standard metering roller is much more rigid. This standard metering roller is somewhat longer than the form roller and has developed to include a steel core, a plastic sleeve pressed onto the core, hard end collars that cap each end of the sleeve and end nuts securing the end collars in place. The sleeve diameter must be cut to within ±0.003 inch of the end collar diameters to ensure a relatively smooth transition between the surfaces. A pair of seal members are urged into contacting relationship with the radial end faces of the form roller and the circumference of each standard metering roller end collar. These seals, together with the nip and surface of each roller immediately above the nip, define a reservoir area into which dampening solution is supplied, the resulting pool being kept at a predetermined depth.

No attempt is made to prevent or minimize the transfer of ink from the inked plate onto the surfaces of the dampening form roller and, therethrough, the dampening metering roller. Indeed, having ink on both the form and metering roller is necessary for the dampening system to function properly. This is because the inked rollers facilitate the formation of the ink/fountain-solution emulsion in the reservoir area.

During printing, the emulsion is milled as it passes through the nip of the two rollers and passes, via the lower surface of the form roller, to the plate—the fountain solution portion of the emulsion wetting the hydrophilic non-image areas of the plate, the ink portion of the emulsion adhering the hydrophobic/oliophilic image areas of the plate.

If, for example, the metering roller working surface is to become hydrophilic for any reason—and thereby not carry any ink—the emulsion will not form properly in the reservoir area and the dampening system will tend to carry too much fountain solution to the plate. This condition leads to printing-quality problems such as washed out images and paper-feed problems caused by curled stock.

During operation of the dampening system the seals slowly wear, particularly the surfaces in contact with the ends of the form roller, and tend to move longitudinally inward toward the juncture of the end collars and the plastic sleeve. If this condition is not timely detected, the seals gradually move inward of the end collars and onto the working surface of the plastic sleeve. At this point, heat builds up and causes the plastic material to melt and form a groove. Once formed, the groove passes excessive amounts of fountain solution to the plate, causing poor print quality, paper curl, etc.

Damage to the ends of the plastic portion of the metering roller could be avoided if the full surface of the metering roller were made of a material similar to the wear resistant end collars. But, in order for the dampener to function properly, the roller would have to have surface characteristics similar to that of the plastic sleeve of the standard metering roller—i.e., hydrophobic.

In addition, because of the relatively soft nature of the plastic sleeve, it is susceptible to nicks and gouges when contacted by tools during adjustment of the dampener or when dropped on a hard surface during handling.

Various metering roller forms and finishes have been experimented with, but without success. For example, metering rollers coated entirely with ceramic, similar o that disclosed by Yokoyama et al, in U.S. Pat. No. 4,991,501, have been tried. But, because of the hydrophilic nature of finished plain ceramic, the needed ink/fountain-solution emulsion could not properly form, causing excessive amounts of fountain solution to be transferred to the plate. Metering rollers have also been produced from various types of plastic compounds, but, because the wear characteristics were poor, have also fail prematurely.

SUMMARY OF THE INVENTION

The invention provides a continuous seal type dampener for an offset lithographic press having he usual plate cylinder, on which lithographic plates can be mounted, the dampener having a frame which is to be mounted on the press adjacent the plate cylinder and having a form roller rotatably supported in the frame contacting a plate on the plate cylinder. The dampener also includes a metering roller rotatably supported between the frames and in pressure contact with the form roller. Seal members are urged against the radial end faces of the form roller and against circumferential end surfaces of the metering roller. Thus, the seal members form the ends of a reservoir area located above the downwardly running nip between the rollers. Fountain solution is maintained at a predetermined depth in the reservoir area.

As in the prior continuous seal dampeners, the form roller and metering roller have ink receptive surfaces, and the surface of the metering roller is substantially less resilient than the surface of said form roller, thus the metering roller tends to indent somewhat into the form roller surface. Dampening fluid and ink are mixed together in the reservoir area resulting in formation of an ink/fountain-solution emulsion.

The improvement to the above described continuous dampener comprises providing a one-piece metering roller having a wear resistant, hydrophobic combination over its entire working surface. Said improved metering roller eliminates the possibility of the seal members from damaging the surface of the metering roller and allows ink to adhere to the working surface of the metering roller to facilitate the formation of the necessary ink/fountain-solution emulsion within the reservoir area.

The principal object of the invention is to provide a metering roller for use in a continuous seal type dampening system having the ink carrying characteristics of a standard metering roller and whose working surface will not be susceptible to damage if the seal members are to wear in excessively.

Another object is to provide a metering roller in a continuous seal type dampening system that cannot be easily damaged if accidentally struck with a tool during dampener adjustment or dropped during handling.

Yet another object is to provide a metering roller in a seal type dampening system that requires less parts, is easier to manufacture, and, thereby, more economical to produce.

Other objects and advantages of the invention will be apparent from the following description, the accompanying drawings, and the appended claims.

DESCRIPTION OF THE PREFERRED EMBODIMENT

Figure 1:
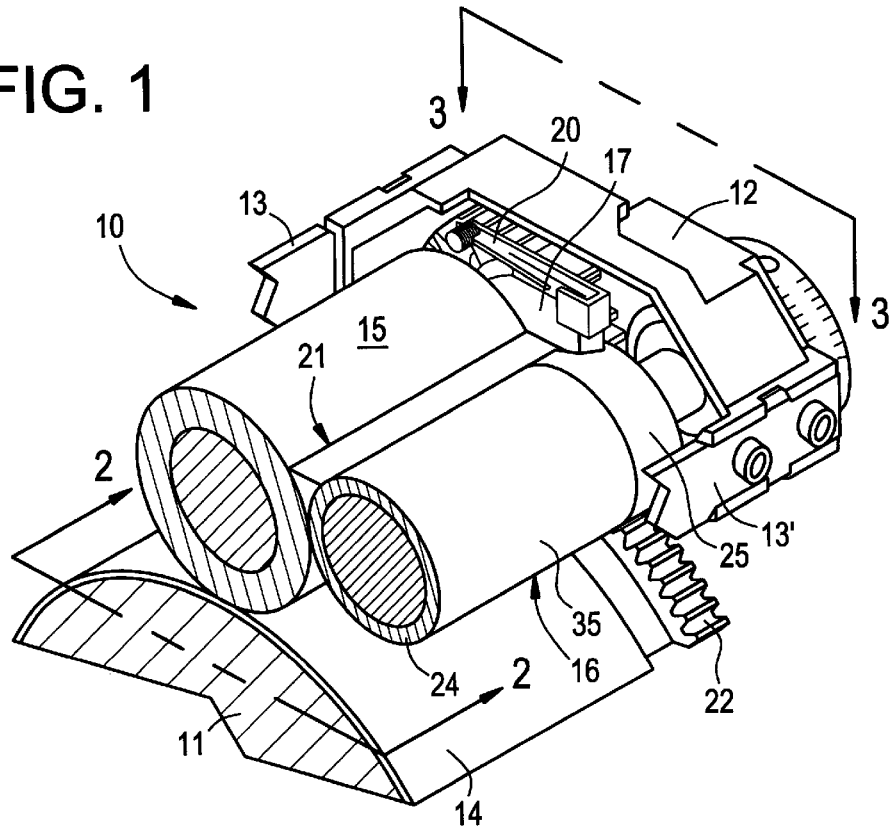
FIG. 1 is a perspective cross sectional view through the principal elements of a dampener built according to U.S. Pat. No. 4,455,938, incorporating the standard metering roller design.
Figure 2:
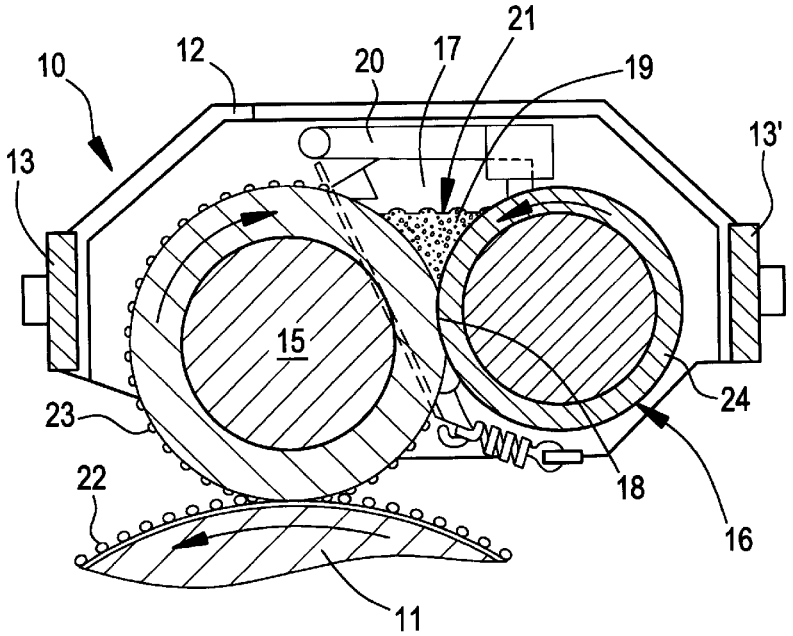
FIG. 2 is a cross-sectional elevation view taken from FIG. 1.

As illustrated in FIG. 1 and FIG. 2, the invention provides a continuous seal type dampener, shown generally at 10, mounted adjacent a plate cylinder 11 of an offset lithographic press (not shown).

Only one side of the dampener is shown in the figures, the opposite side being identical except for a drive gear 23.

The dampener includes side frames 12 tied together with front and rear cross members 13, 13'. Rotatably supported between the side frames 12 and contacting a plate 14 mounted on the plate cylinder 11 is a form roller 15. In pressure contact with the form roller 15 is a standard metering roller 16. The form roller has a steel core and resilient jacket. The standard metering roller 16 is somewhat longer than the form roller and includes a sleeve 24 and hard end collars 25. The end collars 25 cap each end of the sleeve 24, each having nearly matching outside diameters. The length of the sleeve nearly matches that of the form roller. For the dampener to function properly the sleeve surface, or working surface 35, must be hydrophobic so that the printing ink may adhere to it.

Between the form roller 15 and standard metering roller 16 is formed a nip 18. Seal members 17, supported by seal carriers 20, are urged into contacting relationship with the radial ends of the form roller 15 and the circumferential surfaces of the hard and collars 25. The seal members 17 and the area above the nip 18 form a reservoir area 21 wherein an ink/fountain solution emulsion 19 forms during the printing process and is stored prior to being milled through the nip 18. To preserve the radial end surfaces of the form roller 15 and ensure a water-tight seal between the seal members 17 and each roller, the seal members must be made of a low friction, wear-resistant material such as TEFLON. A fountain solution feed mechanism (not shown) supplies and maintains the fountain solution at a predetermined depth.

Form roller 15 and standard metering roller 16 have hydrophobic/ink receptive surfaces. The standard metering roller is substantially less resilient than said form roller, thus the metering roller tends to indent somewhat into the resilient jacket of the form roller at the nip 18. A plate cylinder gear 22 drives the form roller gear 23 causing the plate surface and form roller surface to travel at a one-to-one surface speed ratio. The form roller drives the metering roller by friction.

Figure 3:
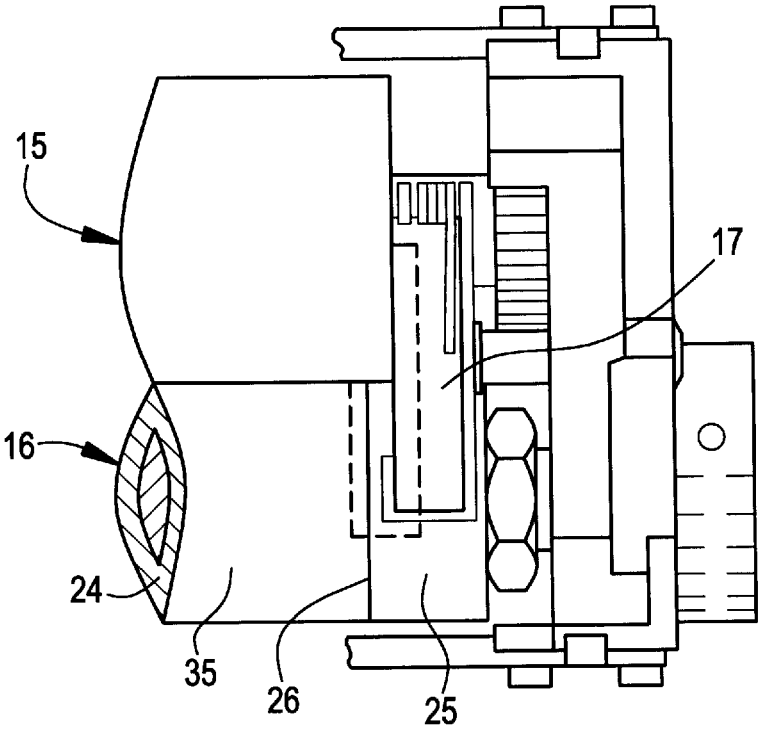
FIG. 3 is a plan view taken from FIG. 1.

FIG. 3 shows the relationship between unworn seal members 17 and the radial end-faces of the form roller 15. As the press operates, the seal members tend to wear away where they contact the radial end-faces and travel longitudinally toward the center of the dampening system (as represented by the dashed outline of the seal). If left unchecked, the seal members continue to travel past a juncture 26 between the hard end collars 25 and sleeve 24 of the standard metering roller 16. Within a very short period of time, the working surface 35 beneath the seal members 17 heats up and deteriorates. It is in this area that excess fountain solution will flow and cause printing problems. It is more typical than not that once the seal has caused the working surface to become damaged, the dampening system must be removed, dismantled, and the metering roller replaced at great expense to the press owner.

Figure 4:
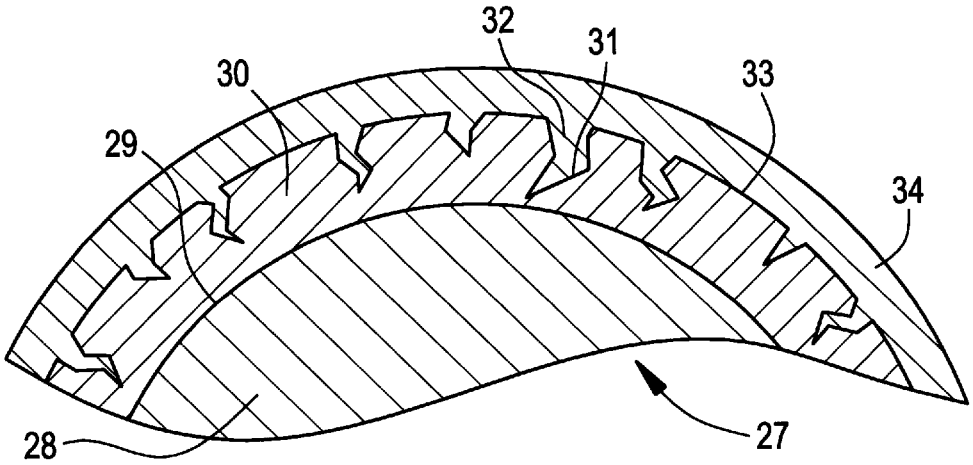
FIG. 4 is cross-sectional view of the one-piece metering roller design showing in detail the structure of the surface combination.

FIG. 4 shows a portion of a one-piece metering roller design 27 that maintains the hydrophobic surface characteristics of the standard metering roller 16 but eliminates the possibility of the seal members 17 from damaging its surface. The proportions of the combination shown in FIG. 4 have been exaggerated for illustrative purposes.

To ensure that the working surface of the one-piece metering roller 27 is hydrophobic, it is readily understood that the surface energy of the metering roller must be below that of the fountain solution (typically 60 to 70 dynes/cm) and, consequently, close to that of the printing ink (typically 30–35 dynes/cm). Maintaining the surface energy of the one-piece metering roller below that of the fountain solution allows the fountain solution to bead-up on the surface of the roller. This, in turn, allows the ink to adhere to its unwetted surface.

The one-piece metering roller 27 is formed by first preparing a steel core 28 having overall dimensions generally the same as that of the standard metering roller 16. The core surface 29 should be finished to no greater than 63 micro-inch (e.g., 32 micro-inch). Then, chromium oxide particles, 80 to 120 microns in size, are flame sprayed so to fuse onto the core surface 29 and form a ceramic coating 30. Characteristic of this process is the formation of microscopic pores 31 in the surface of the coating. Next, a pore occluding coat of epoxy sealer 32, such as Praxair Surface Technologies' UCAR 100 is applied to the ceramic surface 33, filling the microscopic pores 31. UCAR 100 sealant was specially designed by Praxair for sealing the very fine microporosity in flame-sprayed coatings by impregnation with a thermosetting epoxy resin. The hardener used in UCAR 100 provides a cured epoxy system with high impact and thermal shock resistance and good adhesive properties. In its cured state, UCAR 100 provides a surface energy in the order of 31 dynes/cm. The sealer may be applied by brushing, spraying, or dipping the roller. After the pore occluding coathas cured, the ceramic surface 33 is ground to a finish of 20 to 30 micro-inches.

Following grinding, a finish coat of epoxy sealer 34 is applied. The finish coat of sealer, as the pore occluding coat, may be applied by brushing, spraying, or dipping the roller. The resulting metering roller surface is thus a matrix of ceramic having the microscopic pores 31 filled and surface

33 coated with epoxy sealer 32, 34. The surface combination has a thickness of 0.003 to 0.010 inches. The total surface energy of the metering roller produced as disclosed is in the order of 31 dynes/cm and thus is hydrophobic as required for the proper operation of the continuous seal type dampening system as disclosed in U.S. Pat. No. 4,455,938.

It is important that Praxair's UCAR 100, or a material having similar cured surface energy properties, is used as the roller sealant because it causes the typically hydrophilic ceramic roller surface, having a surface energy near that of fountain solution (approximately 60 to 70 dynes/cm) to become hydrophobic, and, thereby, oliophilic. A satisfactory surface energy range has been found to be 30 to 40 dynes/cm.

Rollers having only the finish coat of sealant applied have been produced and successfully tested. However, it has been found that a more consistent, and thereby more functionally reliable, surface is achieved by including the pore occluding coat 32 of sealant to fill the microscopic pores.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A dampener for an offset lithographic press, said press having a plate cylinder on which a lithographic plate can be mounted, said dampener comprising a frame adapted for mounting the dampener adjacent the plate cylinder;

a form roller rotatably supported in said frame and able to contact the plate on the plate cylinder;

a one-piece metering roller having a core, said roller rotatably supported in said frame and whose outside diameter is in pressure contact with, and thereby forming a nip with, said form roller;

seal means adjacent to the ends of said rollers and working in cooperative relation therewith to define a reservoir area above said nip;

means providing a supply of dampening solution to said reservoir area; and drive means rotating said rollers at a one-to-one surface speed ratio with each other and with the plate cylinder the improvement comprising:

said one-piece metering roller having a continuous ceramic coating over the core surface and a hydrophobic finish coat of sealer over the ceramic coating, said finish coat of sealer having a surface energy below 60 dynes/cm.

2. A dampener as defined in claim 1, wherein said finish coat of sealer has a surface energy in the order of 30 to 40 dynes/cm.

3. A dampener as defined in claim 1, wherein said core surface is finished to 63 micro-inch or less.

4. A dampener as defined in claim 1, wherein said ceramic coating under the finish coat of sealer, is ground to a finish of 20 to 30 micro-inch.

5. A dampener as defined in claim 4, further comprising a pore occluding coat of sealer on the unfinished ceramic coating.

6. A dampener as defined in claim 5, wherein said pore occluding coat and said finish coat of sealer are epoxy resin.

* * * * *